United States Patent [19]

Aldridge et al.

[11] Patent Number: 4,765,882

[45] Date of Patent: Aug. 23, 1988

[54] HYDROCONVERSION PROCESS

[75] Inventors: Clyde L. Aldridge; William E. Lewis; Roby Bearden, Jr.; Francis X. Mayer, all of Baton Rouge, La.

[73] Assignee: Exxon Research and Engineering Company, Florham Park, N.J.

[21] Appl. No.: 857,358

[22] Filed: Apr. 30, 1986

[51] Int. Cl.[4] ..... C10G 65/10

[52] U.S. Cl. ..... 208/59; 208/49; 208/78; 208/80; 208/108; 208/112; 208/155

[58] Field of Search ..... 208/57, 58, 59, 78, 208/80, 155, 108, 157, 298, 49, 112

[56] References Cited

U.S. PATENT DOCUMENTS

| | | | |
|---|---|---|---|
| 2,885,346 | 5/1959 | Kearby et al. | 208/59 |
| 3,260,663 | 7/1966 | Inwood et al. | 208/80 |
| 3,297,565 | 1/1967 | Garwood et al. | 208/59 |
| 3,402,121 | 9/1968 | Hallman | 208/59 |
| 3,607,723 | 9/1971 | Peck et al. | 208/80 |
| 3,788,973 | 1/1974 | Wolk et al. | 208/157 |
| 3,809,644 | 5/1974 | Johnson et al. | 208/78 |
| 3,870,623 | 3/1975 | Johnson et al. | 208/157 |
| 3,887,455 | 6/1975 | Hamner et al. | 208/157 |
| 3,974,065 | 8/1976 | Powell e al. | 208/59 |
| 4,059,502 | 11/1977 | James | 208/157 |
| 4,082,647 | 4/1978 | Hutchings et al. | 208/80 |
| 4,133,842 | 1/1979 | Anderson | 208/49 |
| 4,134,825 | 1/1979 | Bearden, Jr. et al. | 208/108 |
| 4,151,070 | 4/1979 | Allan et al. | 208/59 |
| 4,183,801 | 1/1980 | Breuker et al. | 208/59 |
| 4,366,047 | 12/1982 | Winter et al. | 208/57 |
| 4,457,831 | 7/1984 | Gendler | 208/157 |
| 4,502,946 | 3/1985 | Pronk | 208/152 |

*Primary Examiner*—Helen M. S. Sneed
*Assistant Examiner*—Anthony McFarlane
*Attorney, Agent, or Firm*—Henry E. Naylor

[57] ABSTRACT

A slurry catalytic hydroconversion process comprising at least two hydroconversion zones is provided in which the heavy hydrocarbonaceous fresh oil feed is added to more than one hydroconversion zone. Additional portions of catalysts or catalyst precursors are also added to the first hydroconversion zone and to additional hydroconversion zones.

7 Claims, 1 Drawing Sheet

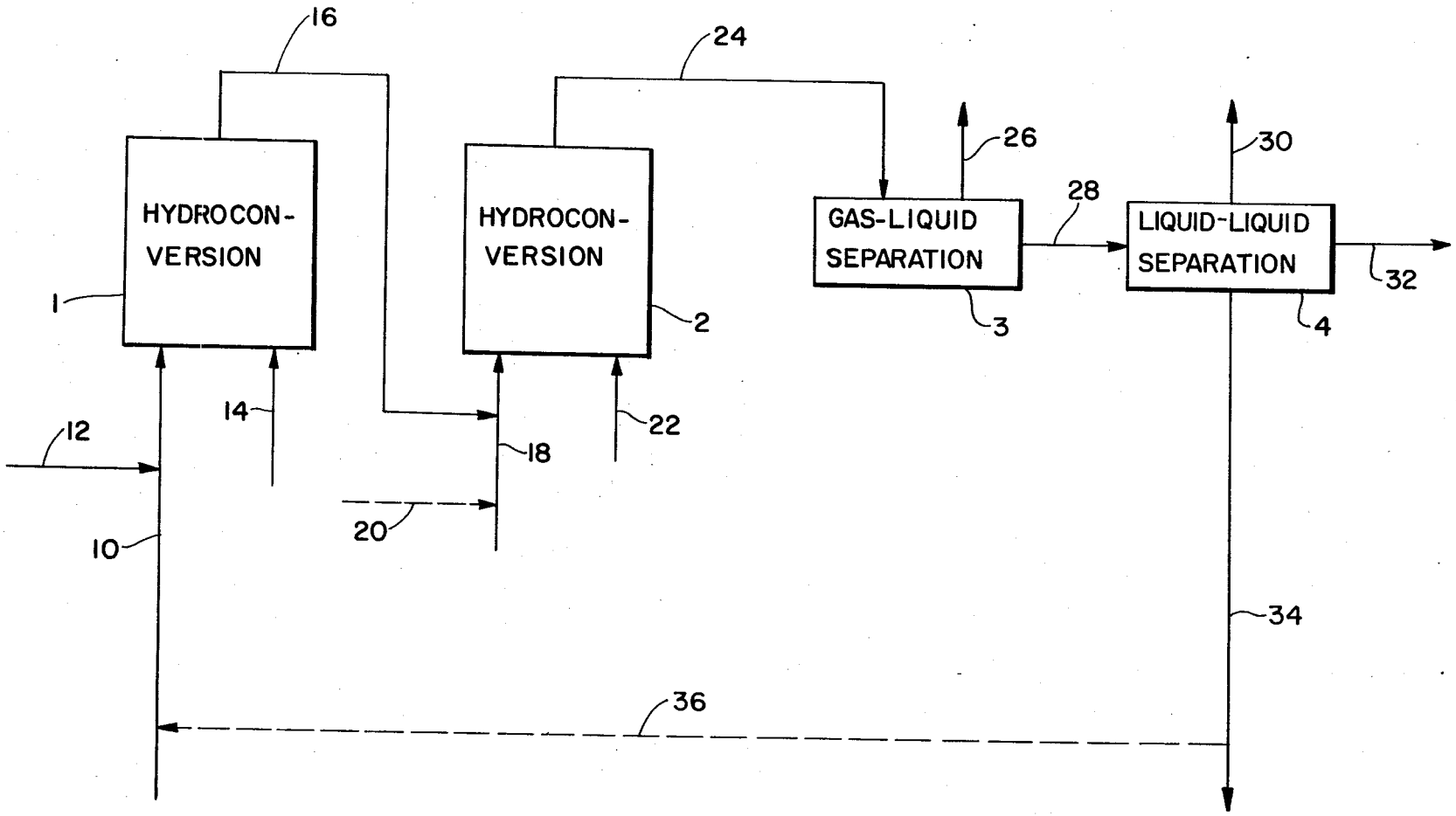
HYDROCON-
VERSION
HYDROCON-
VERSION
GAS-LIQUID
SEPARATION
LIQUID-LIQUID
SEPARATION
1
2
3
4
10
12
14
16
18
20
22
24
26
28
30
32
34
36

HYDROCONVERSION PROCESS

BACKGROUND OF THE INVENTION

1. Field of the Invention

The present invention relates to a slurry hydroconversion process.

2. Description of Information Disclosures

Slurry hydroconversion processes in which a catalyst is dispersed in a hydrocarbonaceous oil to convert the oil in the presence of hydrogen are known.

U.S. Pat. No. 4,134,825 discloses a catalytic slurry hydroconversion process using a catalyst produced in the oil feed from a catalyst precursor.

U.S. Pat. No. 4,151,070 discloses a staged hydroconversion process in which the liquid effluent of the first hydroconversion zone is separated into fractions and in which the heavy fraction is passed to a second hydroconversion zone. The first hydroconversion zone is operated at a lower severity than the second hydroconversion zone.

The term "hydroconversion" is used herein to designate a process conducted in the presence of hydrogen in which at least a portion of the heavy constituents of the hydrocarbonaceous oil is converted to lower boiling hydrocarbonaceous products while it may simultaneously reduce the concentration of nitrogenous compounds, sulfur compounds, and metallic contaminants.

It has now been found that adding the fresh oil feed to more than one hydroconversion zone of a plurality of serially connected hydroconversion zones will provide advantages, for example, a decrease in hydrogen preheat requirement and a decrease in overall catalyst requirement.

SUMMARY OF THE INVENTION

In accordance with the invention, there is provided, in a slurry hydroconversion process comprising at least two zones, which comprises the steps of: (a) adding a catalyst or catalyst precursor to a chargestock comprising a first portion of a fresh heavy hydrocarbonaceous oil chargestock to form a mixture; (b) reacting the resulting mixture with a hydrogen-containing gas in a first hydroconversion zone at first hydroconversion conditions to produce a first hydroconverted oil; (c) introducing at least a portion of the effluent of said first hydroconversion zone, including at least a portion of said first hydroconverted oil, into a second hydroconversion zone at second hydroconversion conditions to react with a hydrogen-containing gas and produce a second hydroconverted oil, the improvement which comprises: introducing a second portion of said fresh heavy hydrocarbonaceous oil to said second hydroconversion zone.

BRIEF DESCRIPTION OF THE DRAWING

The FIGURE is a schematic flow plan of one embodiment of the invention.

DESCRIPTION OF THE PREFERRED EMBODIMENT

Referring to the FIGURE, a heavy hydrocarbonaceous oil feed carried in line 10 in admixture with the catalyst or catalyst precursor introduced into the oil by line 12 is passed into hydroconversion zone 1 which is the first of a series of related hydroconversion zones.

The Heavy Hydrocarbonaceous Oil Feed

Suitable hydrocarbonaceous oil feeds include heavy mineral oils, whole or topped crude oils, including heavy crude oils; asphaltenes; hydrocarbonaceous oil boiling above 650° F. (343.33° C.); petroleum atmospheric residuum (boiling above 650° F.); petroleum vacuum residua boiling above 1050° F. (565.56° C.); tars; bitumen; tar sand oils; shale oils; liquid products derived from coal liquefaction processes, including coal liquefaction bottoms, and mixtures thereof. The process is particularly suitable to convert heavy crude oils and residual oils containing materials boiling above 1050° F. and which generally contain a high content of metallic contaminants (nickel, iron, vanadium) usually present in the form of organometallic contaminants, a high content of sulfur compounds, nitrogenous compounds and a high Conradson carbon residue. The metallic content of such oils may range up to 2000 wppm or more and the sulfur content may range up to 8 wt. % or more. Preferably, the feed is a heavy hydrocarbon oil comprising materials boiling above 1050° F., more preferably having at least about 10 wt. % materials boiling above 1050° F. To any of these feeds may be added coal.

All boiling points referred to herein are equivalent atmospheric pressure boiling points unless otherwise specified. Whenever reference is made herein to fresh feed, it is intended that it is not a recycle stream; however, the fresh feed may be a cracked oil derived from other processes.

The Hydroconversion Catalyst

The hydroconversion catalyst introduced via line 12 into the oil feed to form a dispersion of the catalyst in the oil may be any suitable hydroconversion catalyst or catalyst precursor suitable for use in slurry processes (i.e., a process in which the catalyst is admixed with the oil). The catalyst may comprise a Group VB, Group VIB or Group VIII metal, metal oxide or metal sulfide and mixtures thereof and may be a supported or unsupported catalyst. Instead of introducing a preformed catalyst via line 12, a catalyst precursor may be used such as an oil soluble metal compound or a thermally decomposable metal compound such as the catalyst precursors described in U.S. Pat. No. 4,134,825, the teachings of which are hereby incorporated by reference. Catalysts comprising cobalt, molybdenum, nickel, tungsten, iron and mixtures thereof on an alumina-containing support or on solid carbonaceous supports, such as coal or coke, are also suitable.

A hydrogen-containing gas is introduced into hydroconversion zone 1 by line 14. The hydrogen-containing gas may be pure hydrogen, but will generally be an impure hydrogen stream such as a hydrogen-containing gas derived from a process, e.g., reformer offgas. Although the FIGURE shows the hydrogen being introduced directly into the hydroconversion zone, it is to be understood that the hydrogen-containing gas of line 14 could be introduced into oil feed line 10 and passed into the hydroconversion zone in admixture with the oil. In hydroconversion zone 1, the oil feed is subjected to hydroconversion conditions to convert at least a portion of the oil to lower boiling hydrocarbonaceous products.

Slurry Hydroconversion Conditions

Suitable operating conditions for all the slurry hydroconversion zones of the process are summarized in Table I.

TABLE I

| Conditions for all Reactors | Broad Range | Preferred Range |
|---|---|---|
| Temperature, °F. | 800–900 | 820–870 |
| $H_2$ partial pressure, psig | 50–5,000 | 100–2,500 |
| $H_2$-containing gas rate, SCF/bbl | 2000–30,000 | 4,000–20,000 |

The hydroconversion zone effluent comprising a normally gaseous phase, a normally liquid phase and catalyst particles is removed from hydroconversion zone 1 by line 16. If desired, at least a portion of the gaseous phase may be removed from the effluent. The effluent of hydroconversion zone 1 comprising the normally liquid phase is passed into hydroconversion zone 2 which is the second hydroconversion zone into which an additional portion of fresh oil chargestock is introduced by line 18. The fresh oil is a portion of the same oil that was introduced by line 10 into hydroconversion zone 1. An additional portion of catalyst or catalyst precursor may be introduced by line 20 into fresh feed line 18. An additional hydrogen-containing gas may be introduced into hydroconversion zone 2. If the gas phase had been removed from the effluent of the first hydroconversion zone, then introduction of the required hydrogen would be made via line 22. As previously described, the hydrogen of line 22 may be introduced into fresh feed line 18 or it may be introduced directly into hydroconversion zone 2. The effluent of hydroconversion zone 2 is removed by line 24 and, if desired, may be passed with or without separation of gas phase from the liquid into additional hydroconversion zones (not shown) into which additional portions of fresh feed may be introduced. It should be noted that it is not required that the additional portion of fresh feed be introduced into a specific second hydroconversion zone. The additional portion of fresh feed may be introduced into any one of a series of hydroconversion zones or into each of the hydroconversion zones of a plurality of hydroconversion zones in series. The proportion of fresh feed introduced into the first hydroconversion zone relative to the portion or portions introduced into the subsequent hydroconversion zones is as follows:

| First Hydroconversion Zone | | Subsequent Hydroconversion Zones | |
|---|---|---|---|
| Broad | Preferred | Broad | Preferred |
| 25–90 wt. % | 50–75 wt. % | 10–75 wt. % | 25–50 wt. % |

The actual conditions may be the same in the first, second or any subsequent hydroconversion zone, or may be different within the given ranges.

The effluent of hydroconversion zone 2, which comprises a normally gaseous phase, a normally liquid phase (e.g., hydroconverted oil) and catalyst particles, is passed by line 24 into a gas-liquid separation zone 3. The gaseous phase comprising hydrogen is removed by line 26. If desired, the gas may be recycled to any of the hydroconversion zones with or without additional cleanup.

The normally liquid phase, which comprises hydroconverted hydrocarbonaceous oil and catalytic solids is passed to separation zone 4 for fractionation by conventional means such as distillation, into various fractions, such as light boiling, medium boiling and heavy bottoms fractions containing the catalytic solids. The light fraction is removed by line 30. The medium boiling fraction is removed by line 32. The heavy bottoms fraction is removed by line 34. If desired, at least a portion of the bottoms fraction may be recycled to hydroconversion zone 1 by line 36. Alternatively, if desired, the bottoms fraction may be recycled to hydroconversion zones 1 or 2. When the process comprises more than 2 hydroconversion zones, the heavy bottoms portion separated from the effluent of the last of these hydroconversion zones may be recycled to at least one of the hydroconversion zones.

The following example is presented to illustrate the invention.

EXAMPLE

Seventy percent of a topped Cold Lake feed (780° F.+, containing 74.08 wt.% of 975° F.+ material) was hydroconverted in a first stage at 846° F. and 1923 psi $H_2$ pressure at a feed rate of 0.59 V/V/Hr. (nominal holding time of 1.7 hr. excluding vaporization effects). Molybdenum catalyst was provided in the amount of 225 wppm on feed by adding a concentrate of phosphomolybdic acid in Cold Lake crude. After this first stage, gaseous materials and volatile hydrocarbons were removed to yield 9.76 wt.% of residual material containing the catalyst.

The remaining 30% of the fresh feed was then blended with the effluent from the first stage and the mixture passed to a second hydroconversion stage maintained at 840° F. and 2000 psig with hydrogen for three hours (0.33 V/V/Hr.). After the two-stage treatment the conversion of material boiling above 975° F. in the total fresh feed to oil boiling below 975° F. plus gas was 90.3 wt.%, and toluene insolubles produced amounted to 2.1 wt.% on total fresh feed.

What is claimed is:

1. In a slurry hydroconversion process comprising at least two zones, wherein heavy hydrocarbonaceous oil is converted to lower boiling products, which process comprises the steps of:

(a) adding a catalyst or a catalyst precursor to a chargestock comprising a first portion of fresh heavy hydrocarbonaceous oil comprising at least 10 wt.% of materials boiling above about 1050° F., to form a mixture;

(b) reacting the resulting mixture with a hydrogen-containing gas in a first hydroconversion zone operated at a temperature ranging from about 800° F. to about 900° F. at hydrogen partial pressures from about 50 to 5,000 psig to produce a first hydroconverted oil;

(c) introducing at least a portion of the effluent of said first hydroconversion zone, including at least a portion of said first hydroconverted oil into a second hydroconversion zone also operated at temperatures ranging from about 800° F. to about 900° F. and hydrogen partial pressures from about 50 to 5,000 psig to react with a hydrogen-containing gas and produce a second hydroconverted oil, the improvement which comprises:

(d) introducing a second portion of said fresh heavy hydrocarbonaceous oil to said second hydroconversion zone.

2. The process of claim 1 wherein said slurry hydroconversion process is conducted in more than two slurry hydroconversion zones in series and wherein at least a portion of said fresh hydrocarbonaceous oil is introduced into said first hydroconversion zone and into at least one additional hydroconversion zone.

3. The process of claim 1 wherein said slurry hydroconversion process is conducted in more than two slurry hydroconversion zones in series and wherein at least a portion of said fresh hydrocarbonaceous oil is introduced into each of said hydroconversion zones.

4. The process of claim 1 or 2 wherein said slurry hydroconversion process is conducted in a plurality of slurry hydroconversion zones and wherein a heavy bottoms portion is separated from the effluent of the last of said hydroconversion zones and, thereafter, the separated bottoms portion is recycled to at least one of said hydroconversion zones.

5. The process of claim 1 or 2 wherein an additional portion of said catalyst or catalyst precursor is introduced into at least one of said hydroconversion zones other than said first hydroconversion zone.

6. The process of claim 1 wherein said hydroconversion catalyst precursor is an oil soluble metal compound or a thermally decomposable metal compound.

7. The process of claim 1 wherein said first portion of fresh heavy oil is from 25 to 90 weight percent of the total chargestock of said process.

* * * * *